United States Patent [19]

Bernardis et al.

[11] 3,966,036

[45] June 29, 1976

[54] INKED RIBBON FEED ARRANGEMENT

[75] Inventors: Francesco Bernardis, Ivrea (Turin); Dario Bisone, Montalto Dora (Turin), both of Italy

[73] Assignee: Ing. C. Olivetti & C., S.p.A., Ivrea (Turin), Italy

[22] Filed: Dec. 10, 1974

[21] Appl. No.: 531,258

[30] Foreign Application Priority Data

Dec. 28, 1973 Italy ..... 70876/73

[52] U.S. Cl. ..... 197/82; 197/160

[51] Int. Cl.[2] ..... B41J 19/00

[58] Field of Search ..... 101/336; 197/82, 151, 197/160–165, 167, 170, 174; 242/67.4

[56] References Cited

UNITED STATES PATENTS

| | | | |
|---|---|---|---|
| 2,964,157 | 12/1960 | Knight | 197/171 |
| 3,236,353 | 2/1966 | MacNeill et al. | 197/151 X |
| 3,302,766 | 2/1967 | Page | 197/160 X |
| 3,340,989 | 9/1967 | Busch | 197/60 X |
| 3,354,822 | 11/1967 | Dollot | 197/151 X |
| 3,442,366 | 5/1969 | Spears | 197/151 |
| 3,627,219 | 12/1971 | Hanson et al. | 197/160 X |
| 3,632,052 | 1/1972 | Read | 197/160 X |
| 3,677,176 | 7/1972 | Foley et al. | 197/160 X |

OTHER PUBLICATIONS

"Ribbon Feed Mechanism;" IBM Technical Disclosure Bulletin; vol. 2, No. 6, Apr. 1960, pp. 18 and 19.

*Primary Examiner*—Richard C. Pinkham
*Assistant Examiner*—Vance Y. Hum
*Attorney, Agent, or Firm*—I. J. Schaefer

[57] ABSTRACT

An inked ribbon of a high-speed printer for office machines is wound on two spools connected each one with a corresponding electric motor. The ribbon is transferred stroke by stroke from the feed spool to the take-up spool with a substantially constant tensioning force. To this end an oscillating lever is disposed between the two spools and, cooperating with the ribbon, forms a loop thereof under the action of a tensioning spring. The oscillating lever in correspondence of a minimum and of a maximum of the ribbon loop cooperates with a pair of microswitches which alternately stop and actuate the electric motors in manner that the ribbon is transferred alternately from the feed spool to the loop and from the loop to the take-up spool under the action of the tensioning spring. A changeover device alternates the function of the two spools when the ribbon is fully wound on the take-up spool.

21 Claims, 8 Drawing Figures

INKED RIBBON FEED ARRANGEMENT

BACKGROUND OF THE INVENTION

1. Field of invention

The present invention relates to a feed arrangement for the inked ribbon of a high-speed printer for office machines such as accounting machines, data terminals and teleprinters, which comprises a pair of spools for the ribbon.

2. Description of the prior art

In high-speed printers for accounting machines, teleprinters, and similar machines, it is important that the feed of the ribbon should take place in a reliable manner and by means of mechanisms which are not very bulky.

In these printers, an inked ribbon of considerable length is moreover used, so that the diameter of the feed spool varies considerably from the time when the spool is full to when the ribbon is fully unwound. The pull to which the ribbon is subjected consequently varies considerably in the course of the unwinding of the ribbon from the feed spool to the take-up spool. This therefore gives rise to an unacceptable slackening of the ribbon or to an excessive stress thereon, with the danger of high rates of wear or of tearing.

An arrangement is known in which each feed and take-up spool is associated with an electric motor of the type having an axially movable rotor and is mounted on the frame of the machine. When these motors are supplied, they shift the rotor axially simultaneously with the starting of the rotation in such manner as to bring a driving pinion keyed on the rotor itself into engagement with a driven gear connected to the corresponding spool. In this arrangement, with the pinion disengaged, the slidable rotor actuates, through a spring, a shoe which brakes the driven gear. When a motor is supplied, the corresponding shoe is raised and the take-up spool is freely rotated by the motor itself. The other motor, on the other hand, is inhibited, as a result of which the corresponding shoe co-operates with the corresponding driven gear, thus checking the unwinding of the ribbon on the feed spool.

This arrangement has the disadvantage that, since the feed spool is checked or braked with a constant resisting torque, the corresponding resisting force applied to the ribbon is variable and is all the greater the smaller the winding diameter of the ribbon on the spool.

An arrangement for feeding an inked typewriter ribbon is moreover known in which the ribbon passes from a feed spool to a take-up spool. The feed spool is freely rotatable on the carriage bearing the typing head together with the take-up spool and is kept locked by a ribbon tightener pulled by a spring, with a predetermined loop of the ribbon being formed by the said ribbon tightener. With the feed spool stationary, the ribbon passes from the loop to the take-up spool. When the loop reches a minimum, the ribbon tightener releases the feed spool, which reforms the loop, bringing it back to its predetermined value and locking the feed spool again. In this arrangement, when the ribbon is transferred from the loop to the take-up spool, the pull on the ribbon remains sufficiently constant, but when the ribbon tightener releases the feed spool the pull decreases rapidly, therefore only partially solving the disadvantages hereinbefore described.

SUMMARY OF THE INVENTION

The object of the present invention is to provide an arrangement in which the ribbon is fed intermittently with a substantially constant tensioning force.

According to the present invention there is provided a feed arrangement for an inked ribbon, comprising a pair of spools for the ribbon, serving one for feed and one for take-up of the ribbon, an oscillating lever biased to form a loop in the ribbon, first switching means operated by the oscillating lever in a first position for commanding the stopping of the take-up spool and the rotation of the feed spool, second switching means operated by the oscillating lever in a second position for commanding the stopping of the feed spool and the rotation of the take-up spool, so that, the ribbon is alternately transferred from the feed spool to the loop and from the loop to the take-up spool with a substantially constant pull determined by the bias on the oscillating lever.

BRIEF DESCRIPTION OF THE DRAWING

The invention will be described in more detail, by way of example, with reference to the accompanying drawings, wherein.

DESCRIPTION OF A PREFERRED EMBODIMENT OF THE INVENTION

Figure 1:
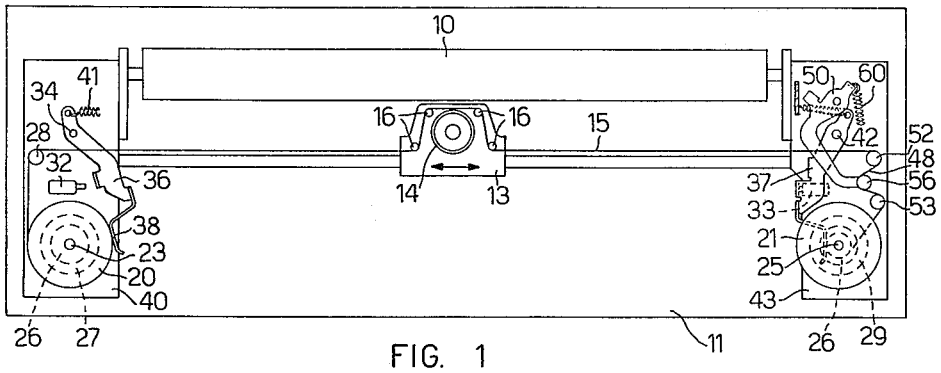
FIG. 1 is a diagrammatic plan view of an office machine using an arrangement embodying the invention.

The arrangement embodying the invention for feeding the inked ribbon is adapted to be applied in an office machine such as, for example, an accounting machine, a data terminal or a teleprinter, of the type in which the feed and take-up spools for the ribbon are mounted rotatably on the fixed frame of the machine.

More particularly, in the embodiment described herein, the arrangement is shown applied to an office machine comprising a platen 10 (FIG. 1) rotatable on a supporting frame 11 and parallel to which there moves a carriage 13 bearing a printing head 14 of known type, for example of the type described in U.S. Pat. application Ser. No. 494,422 filed on Aug. 5, 1974.

Interposed between the head 14 and the platen 10 and guided by rollers 16 of the carriage 13 there is arranged an inked ribbon 15 which can be wound alternately on two flanged spools 20 and 21 arranged one to the right and the other to the left of the platen 10.

The spools 20 and 21 are mounted on shafts 23 and 25, each rotatable on a plate 40 and 43, respectively, of the supporting frame 11. The shafts 23 and 25 are connected through torque limiting clutches 26, known per se, to electric motors 27 and 29, respectively.

Figure 4:
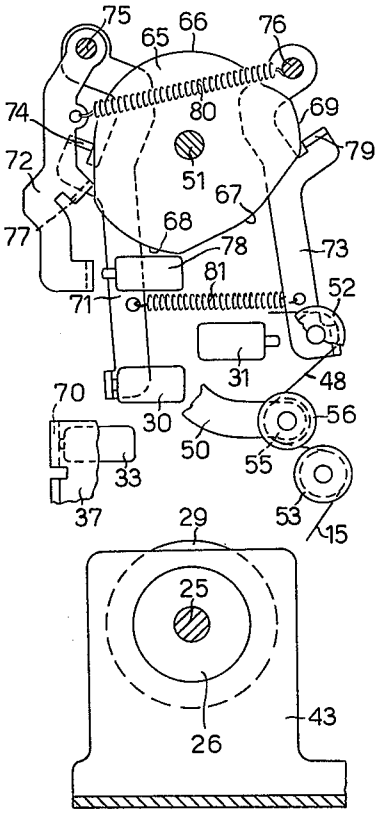
FIG. 4 is a plan view, partly in section, showing other details of the arrangement in the first working position.

The two electric motors 27 and 29 which, for example, are of the type supplied with direct current, are driven by the electric circuit shown in FIG. 8, which will be described in detail hereinafter, in response to the signals generated by four normally open microswitches 30, 31, 32 and 33 (FIGS. 1 and 4).

The motors 27 and 29 each comprise a reduction gear arranged inside the casing of the motors themselves and not shown in the drawing. The high reduction ratio produced by these reduction gears makes the transmission of the motion between the spools and the motors irreversible. That is, the shaft of each motor can rotate only when the corresponding motor is directly supplied with a predetermined voltage, while it is practicaly speaking impossible to cause the shafts of the motors 27 and 29 to rotate by acting on the shafts 23 and 25.

The motors 27 and 29 are moreover reversible, so that by suitably reversing the supply voltage they can rotate in either one of the two directions of rotation.

In the proximity of each of the spools 20 and 21 there is arranged a lever 36, 37, respectively, provided with a shoe 38, 39, respectively, movable between the flanges of the spools 20 and 21. The shoes 38 and 39 are adapted to co-operate with the ribbon 15 wound on the corresponding spool to detect when the ribbon is about to be completely unwound from the spool 20 or 21.

The left-hand lever 36 is pivoted on a pin 34 on the plate 40 and is normally held in contact with the ribbon on the spool 20 by the action of a tension spring 41. The lever 36 is adapted to co-operate with the microswitch 32, which is mounted on the plate 40, on which a ribbon guiding roller 28 is also mounted rotatably.

The right-hand lever 37 (FIG. 3) is pivoted on a spindle 42 on the plate 43 (see also FIG. 2) and has its shoe 39 normally in contact with the ribbon on the spool 21 due to the action of a tension spring 44 stretched between a pin 45 of the lever 37 and one side 46 of a bridge 47 of the plate 43. The lever 37 is moreover provided with a downward projection 70 which is adapted to co-operate with the microswitch 33 (FIG. 4) fixed to the underside of the plate 43.

A ribbon tightening lever 50 (FIG. 3) is keyed on a pin 51 rotatable on the plate 43. By means of a roller 56 mounted at one end 55 of the lever 50, the latter is adapted to form a loop 48 with the ribbon 15 between two ribbon guiding rollers 52 and 53 rotatable on the plate 43. Between a first lug 57 of the ribbon tightening lever 50 and a fixed pin 59 on the plate 43 is stretched a spring 60 which supplies a substantially constant load to the ribbon tightening lever 50. To a second lug 61 of the lever 50 there is fixed a rubber stop 62 adapted to co-operate with a projection 63 of the plate 43 to limit the clockwise rotation of the ribbon tightening lever 50.

On the pin 51, below the plate 43, there is keyed a cam 65 (FIG. 4) having two low profiles 66, 67 and two high profiles 68, 69 with which three lugs 74, 77 and 79 of three levers 71, 72 and 73, respectively, co-operate through the action of a spring 80 stretched between the lever 72 and a pin 76 on the plate 43 and through the action of a spring 81 stretched between the two levers 71 and 73.

Figure 2:
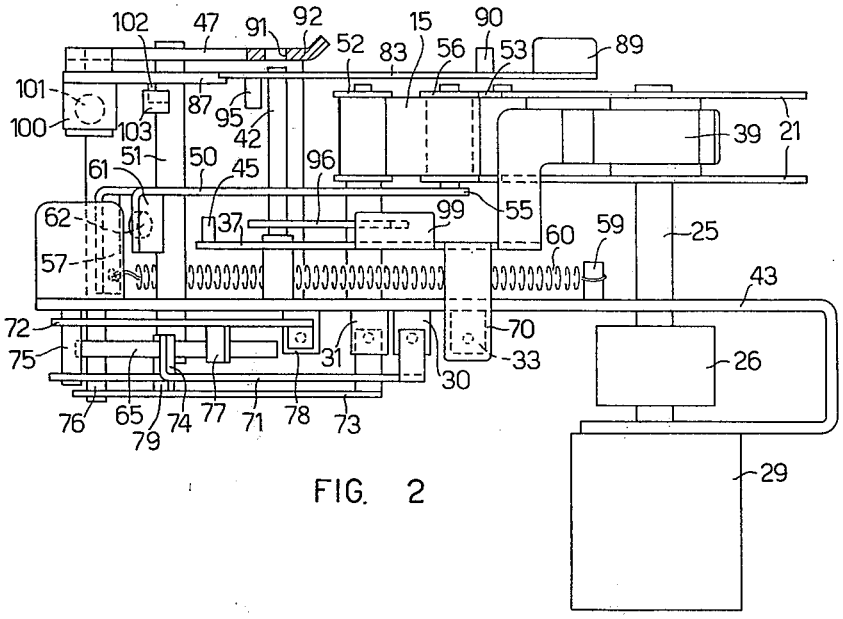
FIG. 2 is a partial side view of the arrangement embodying the invention.

The levers 71 and 72 are pivoted on a pin 75 on the plate 43 and are adapted to co-operate in one case with the microswitch 30 and in the other case with a normally closed microswitch 78, while the lever 73 is pivoted on the pin 76 on the plate 43 and is adapted to co-operate with the microswitch 31. The microswitches 30, 31 and 78 are fixed to the underside of the plate 43 (FIG. 2).

The arrangement moreover comprises a mechanism for facilitating the insertion of the spool 21 on the shaft 25 and its removal therefrom. This mechanism comprises a control lever 83 (FIG. 3) which is keyed on the spindle 42 of the plate 43 and is provided at one end 84 with a toothed sector 85 meshing with a corresponding toothed sector 86 of a lever 87 mounted rotatably on the pin 51.

The control lever 83 is provided with a grip 89 and a pin 90 adapted to co-operate with a slot 91 formed in a projection 92 of the bridge 47. A spring 93 is stretched between the side 46 of the bridge 47 and a pin 95 on the control lever 83. Also keyed on the spindle 42 is an arm 96 having one of its ends 97 adapted to co-operate with a lug 99 of the lever 37.

The lever 87 has an arm 100 adapted to co-operate with a rubber stop 101 carried by the bridge 47 to limit the clockwise rotation of the lever 87. This lever is moreover provided with a bottom tooth 102 adapted to co-operate with a tooth 103 on the pin 51.

The electric driving circuit for the motors 27 and 29 (FIG. 8) is constructed as follows. The two microswitches 30 and 31 are connected to the inputs of a flip-flop 105 of the set-reset type, while the two microswitches 32 and 33 are connected to the inputs of a flip-flop 106 which is also of the set-reset type. One output PV of the flip-flop 105 is connected to an input of a first power NAND element 107 which has its output connected to one terminal 108 of the motor 27; the output PV of the flip-flop 105 is also connected to an input of a second power NAND element 109 which has its output connected to one terminal 110 of the motor 29. Another output PP of the flip-flop 105 is connected to one input of a third power NAND element 111 which has its output connected to another terminal 112 of the motor 27; this output PP is also connected to one input of a fourth power NAND element 113 which has its output connected to another terminal 114 of the motor 29. One output SA of the flip-flop 106 is connected to another input of the second NAND element 109 and to another input of the third NAND element 111. Another output DA of the flip-flop 106 is connected to another input of the first NAND element 107 and to another input of the fourth NAND element 113.

The terminals 108, 110, 112 and 114 of the motors 27 and 29 are connected via four limiting resistors RL to a supply system VA in which the microswitch 78 is connected in series. The NAND elements 107, 109, 111 and 113 each have an earth connection and are of the type in which, when their output is at 0 logical level, connect the output to earth, and when their output is at 1 logical level interrupt the connection between earth and the output.

The apparatus described so far operates in the following manner. Let it be assumed that it is desired to feed an inked ribbon 15, causing it to pass from left to right with respect to the platen 10 (FIG. 1). The substantially full spool 20 represents in this case the feed spool, while the substantially empty spool 21 represents the take-up spool. The feed spool 20 is mounted on the left-hand shaft 23 and the take-up spool 21 is mounted on the right-hand shaft 25. To facilitate this last-mentioned mounting operation, the control lever 83 (FIG.

Figure 6:
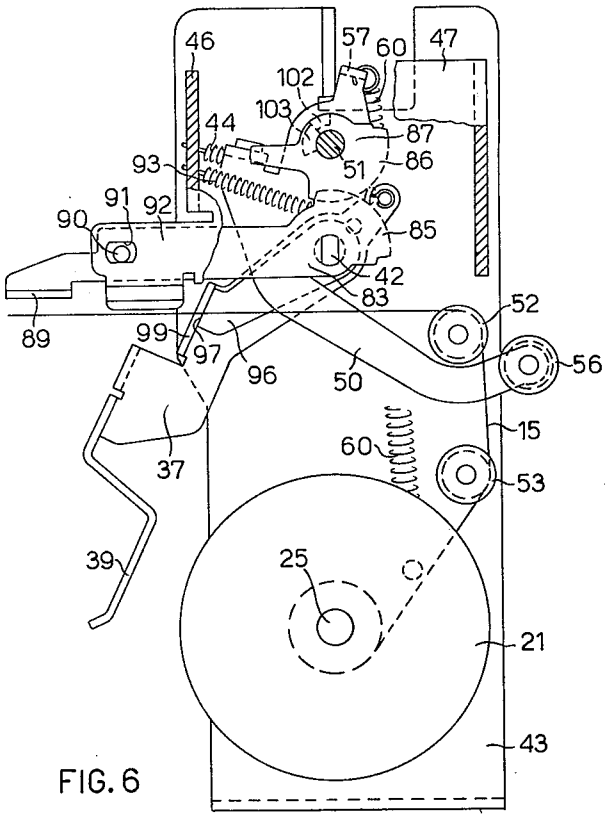
FIG. 6 is another plan view, partly in section, showing the details of FIG. 3 in another working position.

3) is turned clockwise until its pin 90 is caused to be seated in the slot 91 in the projection 92 (FIG. 6). The lever bows slightly as the pin cams into the slot (cf. FIG. 2). The lever 83 thus also causes the arm 96 to rotate clockwise through 90° and the lever 87 to rotate anticlockwise through 90°. In turn, the end 97 of the arm 96 carries the lug 99 of the lever 37 along, causing the latter to rotate clockwise until its shoe 39 is brought beyond the space intended for the flanges of the take-up spool 21. By means of its anticlockwise rotation, the lever 87 causes its tooth 102 to co-operate with the tooth 103 of the pin 51 and causes the pin to rotate until the roller 56 of the ribbon tightening lever 50 is brought out of the normal path of the ribbon 15 between the rollers 52 and 53.

Figure 7:
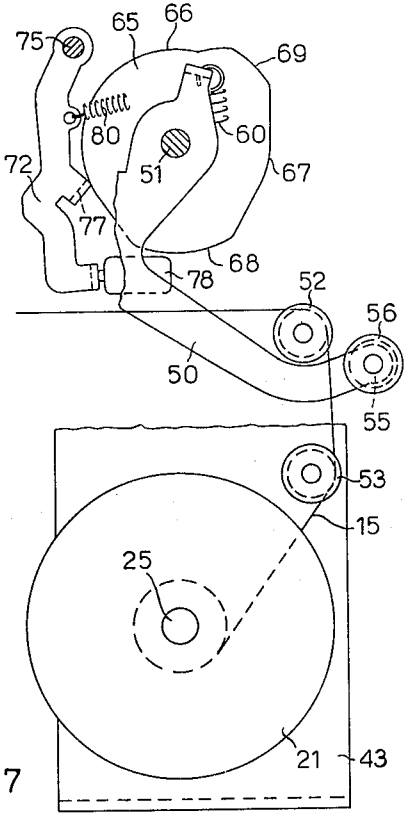
FIG. 7 is a further view, partly in section, showing further details of the arrangement.

With this anticlockwise rotation of the pin 51, the cam 65 (FIG. 7) keyed thereto causes its low profile 66 to co-operate with the lug 77 of the lever 72 which, through the action of the spring 80, thus rotates anticlockwise until it opens the microswitch 78, thus breaking the supply circuit to the motors 27 and 29. With the shoe 39 of the lever 37 well spaced from the shaft 25, the roller 56 of the ribbon tightening lever 50 spaced from the rollers 52 and 53 and the motors 27 and 29 safely at a standstill, the insertion of the spools 20 and 21 on the shafts 23 and 25 and of the ribbon 15 over the ribbon guiding rollers 16, 28, 52 and 53 is therefore facilitated. The lever 36 has a lug allowing it to be held out of the way as the spool 20 is changed.

After threading the inked ribbon 15 between the printing head 14 and the platen 10, the ribbon 15 can be fed from the feed spool 20 to the take-up spool 21.

Figure 3:
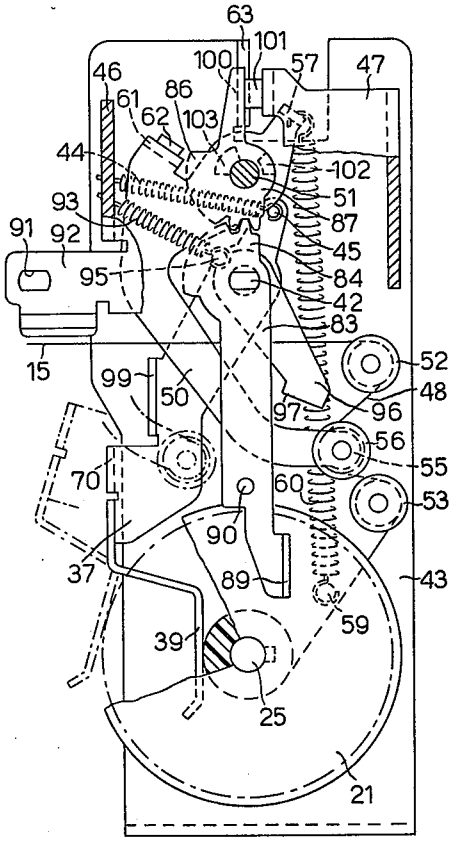
FIG. 3 is a plan view, partly in section, showing a number of details of the arrangement in a first working position.

On disengaging the pin 90 (FIG. 6) from the slot 91, the control lever 83 rotates anticlockwise owing to the action of the spring 93. At the same time, the lever 87 meshing therewith rotates clockwise until it brings its lug 100 against the rubber stop 101 (FIG. 3). The lever 36 (FIG. 1), its shoe 38 being against the ribbon on the spool 20, which is full, is spaced from the corresponding microswitch 32, which thus remains open.

Owing to the action of the spring 44, the lever 37 rotates anticlockwise and brings its shoe 39 into contact with the ribbon on the spool 21, which is substantially empty, and, consequently, its lug 70 actuates the microswitch 33, closing it. Moreover, owing to the action of the spring 60, the ribbon tightening lever 50 rotates clockwise until it brings its roller 56 into contact with the ribbon 15. The load supplied by the spring 60 is such as to place the ribbon under tension along its entire course between the feed spool 20 and the take-up spool 21 and form the loop 48.

Similarly to the ribbon tightening lever 50, the cam 65 (FIG. 4) also rotates clockwise and brings its high profile 68 to co-operate with the lug 77 of the lever 72, spacing the latter from the microswitch 78, which is thus closed. In this position, moreover, the lug 74 of the lever 71 co-operates with the low profile 66 of the cam 65, while the lug 79 of the lever 73 co-operates with the high profile 69. In this way, the lever 71 actuates the microswitch 30, closing it, while the lever 73 is spaced from the microswitch 31, which therefore remains open. With the microswitches 30, 33 and 78 (FIG. 8) closed and the microswitches 31 and 32 open, the levels of the outputs of the flip-flops 105 and 106 are respectively equal to 1 for PV and DA and equal to 0 for PP and SA. Consequently, the outputs of the NAND elements 109, 111 and 113 are at 1 logical level and the output of the NAND element 107 is at 0 logical level. The terminal 108 of the motor 27 is therefore connected to ground on earth and the current, passing from the terminal 112 to the terminal 108, causes this motor 27 to rotate clockwise. The terminals 110 and 114 of the motor 29, on the other hand, remain at the same potential and, consequently, the motor 29 remains at a standstill.

Figure 5:
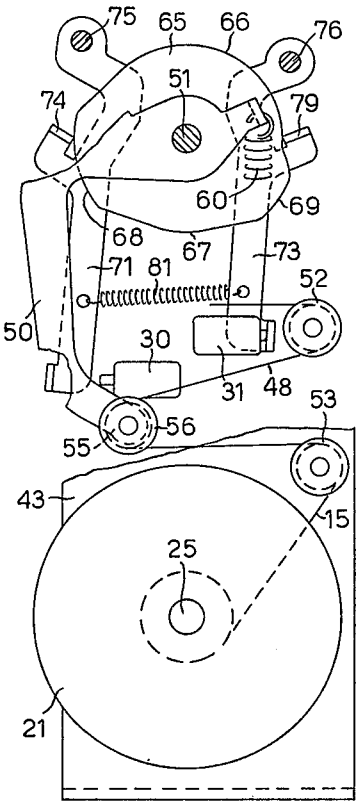
FIG. 5 is a plan view, partly in section, showing the details of FIG. 4 in a second working position.

The ribbon 15 (FIG. 1) is thus transferred from the feed spool 20 to the loop 48 and is pulled by the ribbon tightening lever 50 under the substantially constant load of the spring 60, so that the ribbon 15 stretched between the rollers 28 and 52 is subjected to a constant pull. The loop 48 of the ribbon 15 between the rollers 52 and 53 is moreover increased while the lever 50 is rotated clockwise together with the cam 65 (FIG. 5). After a brief rotation of the cam 65, the lever 71 disengages itself from the microswitch 30, which opens, and, after cam 65 has rotated through about 30°, the lug 79 of the lever 73 co-operates with the low profile 66, causing the last-mentioned lever 73 to actuate the microswitch 31, which is thus closed. With the same clockwise rotation of the cam 65 through about 30°, the ribbon tightening lever 50 is brought into a second position in which the loop 48 of the ribbon 15 reaches a predetermined maximum amplitude shown in FIG. 5.

With the opening of the microswitch 30 and the closing of the microswitch 31, the flip-flop 105 (FIG. 8) is changed over and its output PV becomes equal to 0 and its output PP equal to 1. Consequently, the outputs of the NAND elements 107, 109 and 111 are brought to 1 logical value, while only the output of the NAND element 113 is brought to 0 logical value. The terminal 114 of the motor 29 is therefore connected to earth and the current, passing from the terminal 110 to the terminal 114, causes this motor 29 to rotate clockwise. The terminals 108 and 112 of the left-hand motor 27, on the other hand, remain at the same potential and, consequently, the motor 27 remains at a standstill. The ribbon 15 is thus wound on the take-up spool 21 (FIG. 3) and is transferred from the previously formed loop 48 to the spool 21. The resisting force supplied by the spring 60 to the ribbon 15 is substantially constant and therefore the ribbon stretched between the rollers 28 and 52 (FIG. 1) is subjected to a constant pull and is wound uniformly on the take-up spool 21. The loop 48 in the ribbon 15 is moreover reduced and the lever 50 rotates anticlockwise together with the cam 65 (FIG. 4).

After a brief anticlockwise rotation of the cam 65, the lever 73 disengages itself from the corresponding microswitch 31, which opens. After an anticlockwise rotation of the cam 65 through about 30°, the ribbon tightening lever 50 reaches a position in which the loop 48 is at the minimum, shown in FIG. 4, in which the cam 65 again causes the lever 71 to co-operate once again with the microswitch 30, closing it. Consequently, the flip-flop 105 (FIG. 8) is changed over and brings its output PV back to 1 logical value and its output PP back to 0 logical value. The motor 29 (FIG. 1) stops and the motor 27 resumes clockwise rotation, causing the ribbon 15 to be transferred from the spool 20 to the loop 48.

Figure 8:
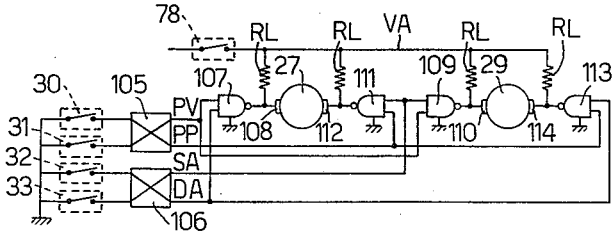
FIG. 8 is a diagram illustrating the electric circuit for controlling the motors of the arrangement.

After a few revolutions of the take-up spool 21, the amount of ribbon 15 taken up is such as to cause the lever 37 to rotate clockwise and thus open the microswitch 33, without this having any effect on the flip-flop 106 (FIG. 8). It is therefore clear that a first change-over device 30 commands the stopping of the take-up spool 21 and the rotation of the feed spool 20. A second changeover device 31 commands the stopping of the feed spool 20 and the rotation of the take-up spool 21. A sequencing element 65 alternates the actuation of the changeover devices 30 and 31 and causes the ribbon 15 to be transferred with a substantially constant pull from the feed spool 20 to the loop 48 and from the latter to the take-up spool 21.

The cycle is repeated in similar manner until such time as the inked ribbon 15 passes completely from the feed spool 20 to the take-up spool 21 (FIG. 1). When the feed spool 20 is almost completely empty, the lever 36, pulled by the spring 41, co-operates with the microswitch 32, closing it.

Since the microswitch 33 is open, the flip-flop 106 (FIG. 8) is changed over and brings its output SA to 1 logical value and its output DA to 0 logical value.

This causes the directions of rotation of the motors 27 and 29 and the feed direction of the ribbon 15 to be reversed. The spool 20 now represents the take-up spool, while the spool 21 represents the feed spool. More particularly, when the ribbon tightening lever 50 (FIG. 4) is in the position in which the loop 48 is at the minimum and the microswitch 30 is closed, the motor 29, coupled to the spool 21 (now the feed spool), rotates anticlockwise unwinding the ribbon 15, which thus passes from the spool 21 to the loop 48, while the motor 27, coupled to the spool 20 (now the take-up spool), remains at a standstill.

On the other hand, when the ribbon tightening lever 50 is brought into the position in which the loop 48 is at the maximum (FIG. 5) and the microswitch 31 is closed, the feed spool motor 29 stops and the take-up spool motor 27 rotates anticlockwise unwinding the ribbon 15, which thus passes from the loop 48 to the spool 20.

In addition to the microswitch 78 being opened in the stage of mounting the spools, it is also opened in the event of breaking of the ribbon 15. In this latter case, owing to the action of the spring 60, the ribbon tightening lever 50 performs a clockwise rotation (FIG. 3) until it is arrested with its stop 62 against the lug 63 of the plate 43. With this clockwise rotation, the cam 65, which rotates together with the lever 50, causes its low profile 67 to co-operate with the lug of the lever 72 (FIG. 4) and, consequently, the latter to co-operate with the microswitch 78, opening it. With the opening of the microswitch 78, the supply to the motors 27 and 29 is therefore interrupted and they consequently stop. The microswitch 78 may be connected to suitable control elements of the printer to which the arrangement is applied, for the purpose of locking the printing members and warning the operator of the need for attention.

The rate of feed of the inked ribbon 15 (FIG. 1) is considerably lower than the speed of transport of the carriage 13; this causes the printing head 14 to work always with a different ribbon zone.

What we claim is:

1. An apparatus for feeding an inked ribbon of a highspeed printer for office machines such as accounting machines, terminals, teleprinters or the like, comprising guide means for guiding said inked ribbon along a predetermined path, and feeding means for intermittently feeding a constant stroke of said inked ribbon along said path, said feeding means comprising actuatable advancing means for advancing the inked ribbon along said path, actuatable stopping means for alternately stopping and releasing the inked ribbon, switching means connected to said advancing means and said stopping means and selectively operable for alternately actuating said advancing means and said stopping means, and means defining said constant stroke, said defining means comprising:

lever means cooperative with said inked ribbon to define a loop thereof corresponding to said constant stroke, and movable between a first position and a second position in which said loop is at a minimum size and at a maximum size respectively, said lever means comprising means cooperative with said switching means; and urging means for urging said lever means from said first position to said second position, said cooperative means actuating said switching means in said first and second position of said lever means for the actuation of said advancing and stopping means.

2. An apparatus according to claim 1, wherein said advancing means comprises a take-up spool on which said inked ribbon is windable, and wherein said stopping means comprises a feed spool on which said inked ribbon is wound, said inked ribbon being transferred by said lever means from said feed spool to said loop under the action of said urging means, and by said advancing means from said loop to said take-up spool against the action of said urging means.

3. An apparatus according to claim 2, further comprising means for sensing when said ribbon is fully wound in said take-up spool, and changeover means cooperative with said sensing means for interchanging the functions of said advancing means and of said stopping means when said inked ribbon is fully wound on said take-up spool.

4. An apparatus according to claim 1, wherein said stopping means comprises motor means operatively connected with said inked ribbon.

5. An apparatus according to claim 4, wherein said motor means and said advancing means each comprise a speed reducing device of the nonreversible type connecting same to said inked ribbon.

6. An apparatus according to claim 4, wherein said stopping means comprises supply means on which said ribbon is lodged and wherein said advancing means comprises take-up means for taking-up said ribbon, and further comprising means for sensing when said ribbon is fully taken-up in said take-up means and changeover means connected to said motor means and to said advancing means for selectively interchanging the functions thereof.

7. An apparatus according to claim 6, wherein said motor means and said advancing means each comprise an electric motor of the bidirectional type, and wherein said changeover means has means for reversing the direction of the supply of said two motors.

8. An apparatus according to claim 1, wherein said advancing means and said releasing means comprise electric devices and wherein said switching means comprises a first and second microswitch actuatable by said lever means in said first and second position, respectively, and storage means for retaining the commands given alternately by said microswitches.

9. An apparatus according to claim 1, wherein said urging means supplies to said lever means a substantially constant tensioning force during the movement of said lever means between said first and second position, whereby said ribbon is transferred with said substantially constant force from said stopping means to said advancing means.

10. An apparatus for feeding an inked ribbon of a highspeed printer for office machines such as accounting machines, terminals, teleprinters or the like, comprising a supply spool wherein said ribbon is lodged, a take-up spool for taking-up said ribbon, first motor means connected to said supply spool for effecting the rotation thereof, second motor means connected to said take-up spool for effecting the rotation thereof, means for intermittently feeding a constant stroke of said inked ribbon from said supply spool to said take-up spool, said feeding means comprising lever means disposed between said two spools and cooperative with said inked ribbon to form a loop thereof corresponding to said contant stroke, said lever means movable between a first position and a second position in which said loop is at a minimum and at a maximum size respectively, means cooperative with said lever means for tensioning said ribbon with a substantially constant force between said supply spool and said takeup spool, first switching means operable by said lever means in said first position for jointly actuating said first motor means and for stopping said second motor means to transfer said ribbon from said supply spool to said loop under the action of said tensioning means and second switching means operable by said lever means in said second position for jointly actuating said second motor means and for stopping said first motor means to transfer said ribbon from said loop to said take-up spool against the action of said tensioning means.

11. An apparatus according to claim 10, wherein said first and second motor means comprises two electrical motors of the bidirectional type and a speed reducing device of the non-reversible type for each motor for connecting each motor to the corresponding one of said spools.

12. An apparatus according to claim 11, wherein each of said electrical motors includes a pair of terminals, the stopping of each spool being effected by bringing the terminals of the corresponding electrical motor to the same electrical potential.

13. An apparatus according to claim 10, further comprising a changeover device which interchanges the function of said two spools when said inked ribbon is fully wound on said take-up spool.

14. An apparatus according to claim 13, wherein said changeover device comprises a pair of sensing elements each cooperating with one of said two spools for sensing the filling thereof, two reversing microswitches actuatable by said sensing elements and first storage means for retaining the commands given alternately by said reversing microswitches.

15. An apparatus according to claim 10, wherein said first and second switching means comprise a first and second microswitch, respectively, actuatable by said lever means in said first and said second position respectively, and second storage means for retaining the command given alternately by said first and second microswitches.

16. An apparatus according to claim 10, wherein said lever means comprises a first oscillable lever having a portion cooperative with said inked ribbon, a cam rigidly connected with said first lever, and a pair of second levers having a first portion cooperative with said cam and a second portion cooperative with said first and second switching means.

17. An apparatus according to claim 10, further comprising arresting means for simultaneously stopping said two spools when said loop is smaller than said minimum or larger than said maximum size.

18. An apparatus according to claim 17, wherein said arresting means comprises a third microswitch actuatable by said lever means for simultaneously stopping said motor means.

19. An apparatus according to claim 10, wherein said pair of spools are removably connectable with said pair of motor means and further comprising a mechanism for facilitating the connection with and, respectively, the removal from the corresponding one of said motor means, said mechanism comprising a release lever cooperative with said lever means and manually movable between an operative position and a release position for bringing said lever means in a predetermined release position.

20. An apparatus for feeding an inked ribbon of a high-speed printer for office machines such as accounting machines, teleprinters or the like, comprising guide means for guiding said inked ribbon along a predetermined path, and feeding means for intermittently feeding a constant stroke of said inked ribbon along said path, said feeding means comprising supply means wherein said ribbon is lodged and actuatable for supplying said ribbon along said path, taking-up means actuatable for taking-up said ribbon, switching means connected to said supply means and said taking-up means for the actuation thereof and selectively operable for alternatively actuating said supply means and said taking-up means and means defining said constant stroke, said defining means comprising:

a member cooperative with said inked ribbon to define a loop thereof corresponding to said constant stroke, and movable between a first position and a second position in which said loop is at a minimum size and at a maximum size respectively;

means cooperative with said switching means and connected to said member; and urging means for urging said member from said first position to said second position, said cooperative means actuating said switching means in said first and second position of said member for the actuation of said taking-up means and said supply means.

21. An apparatus according to claim 20, wherein said supply means comprises a feed spool on which said inked ribbon is wound and wherein said taking-up means comprises a take-up spool on which said inked ribbon is windable, said inked ribbon being transferred by said member from said feed spool to said loop under the action of said urging means, and by said taking-up means from said loop to said take-up spool against the action of said urging means.

* * * * *